US005235972A

United States Patent [19]

Strong

[11] Patent Number: 5,235,972

[45] Date of Patent: Aug. 17, 1993

[54] BREATHING MASK APPARATUS

[76] Inventor: Michael A. Strong, P.O. Box 144, Gordonsville, Va. 22942

[21] Appl. No.: 743,976

[22] Filed: Aug. 12, 1991

[51] Int. Cl.[5] ..... A62B 18/02

[52] U.S. Cl. ..... 128/206.21; 128/206.23

[58] Field of Search ..... 128/201.22, 201.24, 128/201.25, 205.25, 206.23, 205.25, 201.23, 206.21

[56] References Cited

U.S. PATENT DOCUMENTS

| | | | |
|---|---|---|---|
| 2,910,063 | 10/1959 | Monroe et al. | 128/205.25 |
| 2,996,722 | 8/1961 | Jacobs | 128/206.23 |
| 3,259,127 | 7/1966 | Klinger et al. | 128/206.23 |
| 3,315,673 | 4/1967 | Mordon, Jr. | 128/206.23 |
| 3,323,135 | 6/1967 | Miller | 128/206.23 |
| 4,250,877 | 2/1981 | Owens et al. | 128/201.23 |
| 4,328,798 | 5/1982 | Isaacson | 128/205.25 |
| 4,648,394 | 3/1987 | Wise | 128/201.24 |

*Primary Examiner*—Edgar S. Burr
*Assistant Examiner*—Aaron J. Lewis
*Attorney, Agent, or Firm*—Leon Gilden

[57] ABSTRACT

A breathing mask includes a gate structure cooperative with the transparent face plate of the associated gas mask to halt the flow of air through an associated breathing tube to minimize wastage of such air when not in use. The viewing face plate is hingedly mounted within a framework, and when latched in association with a support frame, effects opening of a gate structure within an air conduit, wherein opening of the viewing face plate effects closure of the gate within the conduit.

4 Claims, 4 Drawing Sheets

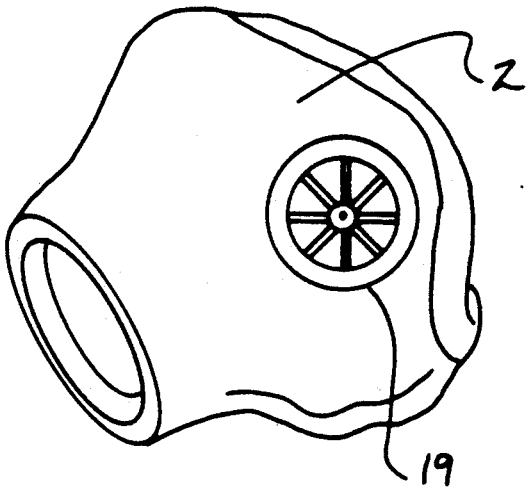
Fig 2
PRIOR ART
Fig 3
PRIOR ART
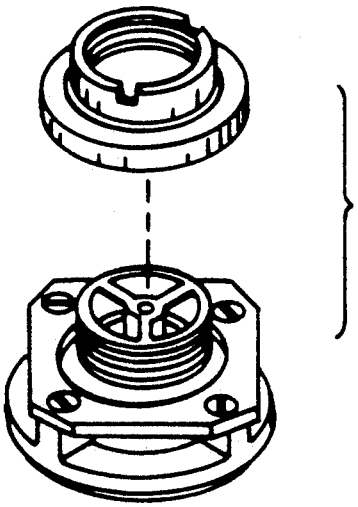

BREATHING MASK APPARATUS

BACKGROUND OF THE INVENTION

1. Field of the Invention

The field of invention relates to breathing mask apparatus, and more particularly pertains to a new and improved breathing mask apparatus wherein the same is arranged to minimize wastage and loss of air during periods of non-use.

2. Description of the Prior Art

The instant invention sets forth an improvement over a prior art mask structure as manufactured by "Mine Safety Appliances Co. of Pittsburg, Pa." set forth as model 401 for example, that sets forth the use of a forced air mask system. The instant organization may be utilized with a variety of masks such as a pressure-demand system if required. The MSA Air Mask Organization commercially available as model 401 utilized by firemen, policemen, and the like requiring independent air sources to provide proper breathing in various noxious environments. U.S. Pat. Nos. 3,323,135 and 3,348,537 are directed to the MSA air mask structure model 401.

Further, U.S. patents directed to self-contained breathing apparatus are presented in U.S. Pat. No. 4,714,077 to Limbert; U.S. Pat. No. 3,957,044 to Fletcher, et al.; U.S. Pat. No. 4,409,978 to Bartos; U.S. Pat. No. 4,841,953 to Dodrill; and U.S. Pat. No. 4,817,597.

Accordingly, it may be appreciated that there continues to be a need for a new and improved breathing mask apparatus as set forth by the instant invention which addresses both the problems of ease of use as well as effectiveness in construction in minimizing loss of self-contained air to minimize such usage and prolong the effective available time from transported air and in this respect, the present invention substantially fulfills this need.

SUMMARY OF THE INVENTION

In view of the foregoing disadvantages inherent in the known types of air mask apparatus now present in the prior art, the present invention provides a breathing mask apparatus wherein the same utilizes a valve structure mounted within the mask to halt artificial air to an individual upon manual displacement of a viewing shield in the mask structure. As such, the general purpose of the present invention, which will be described subsequently in greater detail, is to provide a new and improved breathing mask apparatus which has all the advantages of the prior art air mask apparatus and none of the disadvantages.

To attain this, the present invention provides a breathing mask including a gate structure cooperative with the transparent face plate of the associated gas mask to halt the flow of air through an associated breathing tube to minimize wastage of such air when not in use. The viewing face plate is hingedly mounted within a framework, and when latched in association with a support frame, effects opening of a gate structure Within an air conduit, wherein opening of the viewing face plate effects closure of the gate within the conduit My invention resides not in any one of these features per se, but rather in the particular combination of all of them herein disclosed and claimed and it is distinguished from the prior art in this particular combination of all of its structures or the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved breathing mask apparatus which has all the advantages of the prior art air mask apparatus and none of the disadvantages.

It is another object of the present invention to provide a new and improved breathing mask apparatus which may be easily and efficiently manufactured and marketed.

It is a further object of the present invention to provide a new and improved breathing mask apparatus which is of a durable and reliable construction.

An even further object of the present invention is to provide a new and improved breathing mask apparatus which is susceptible of a low cost of manufacture with regard to both materials and labor, and which accordingly is then susceptible of low prices of sale to the consuming public, thereby making such breathing mask apparatus economically available to the buying public.

Still yet another object of the present invention is to provide a new and improved breathing mask apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an isometric illustration of a nose cup assembly utilized within the mask structure of FIG. 1.

FIG. 3 is an isometric illustration of an exhalation valve assembly for use by the breathing mask structure, as set forth in FIG. 1.

DESCRIPTION OF THE PREFERRED EMBODIMENT

Figure 1:
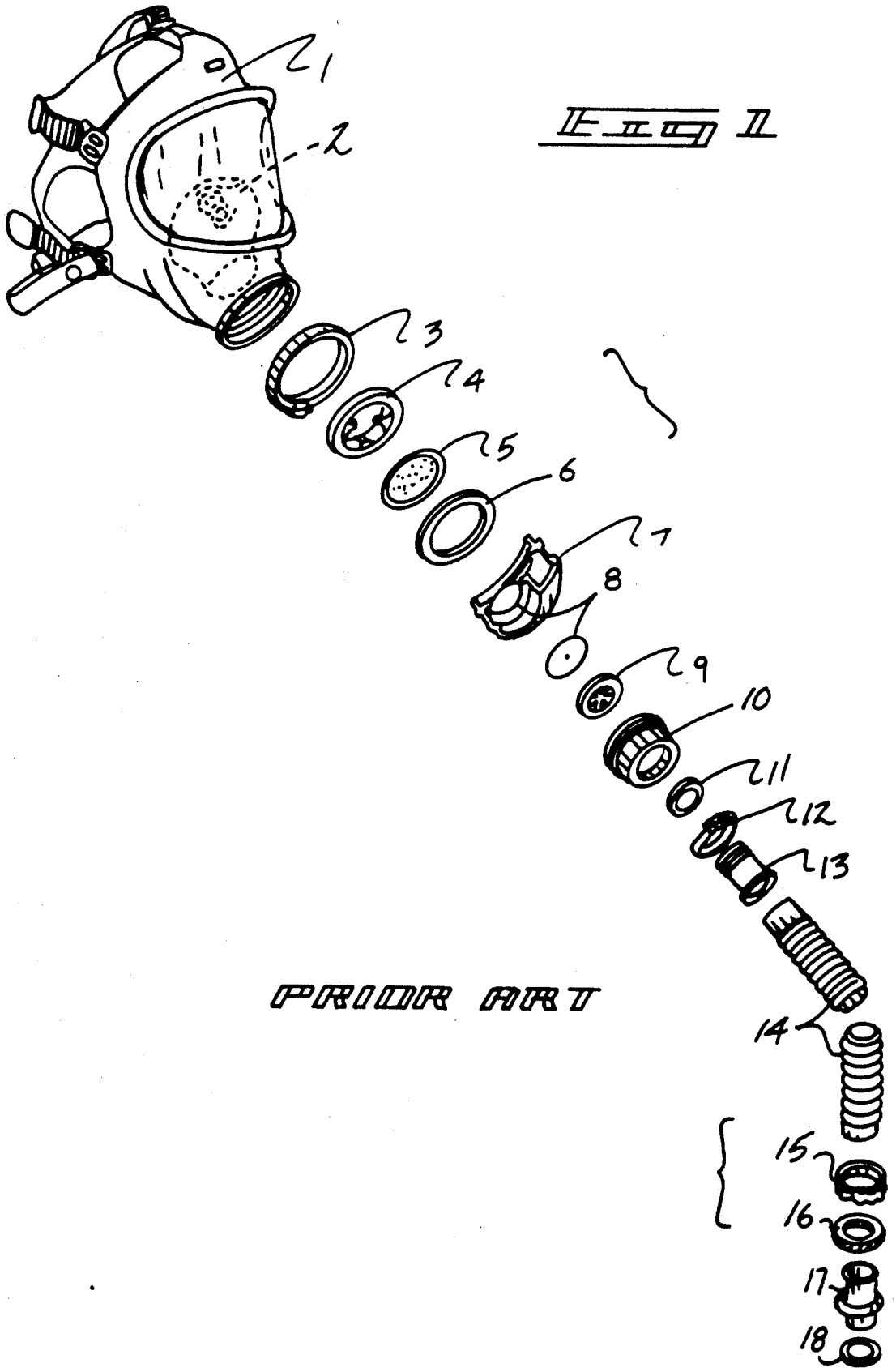
Fig 1 PRIOR ART
FIG. 1 is an isometric illustration of a prior art breathing mask apparatus.

With reference now to the drawings, and in particular to FIGS. 1 to 6 thereof, a new and improved breathing mask apparatus embodying the principles and concepts of the present invention and generally designated by the reference numeral 20 will be described.

FIGS. 1 illustrates a prior art breathing mask apparatus, as commercially available through the Mine Safety Appliances Co. of Pittsburg, Pa., presented as model 401. The mask structure includes a face mask 1 including an arcuate viewing lens, with a nose cup assembly 2 positioned therewithin. A clamp 3 clamps a retainer ring 4, a speaking diaphragm 5, a gasket 6, an inhalation speaking diaphragm 7, including a disc valve 8 positioned therewithin. A gasket valve spider 9, an adapter assembly 10 through a gasket 11 and clamp 12 is secured to a threaded insert 13 that in turn secures a breathing tube 14. The clamp 15, coupling nut 16, and breathing tube insert 17 are operative through a gasket 18 for association with an artificial air supply. The nose cup assembly 2, as illustrated in FIG. 2, to include a plurality of inhalation disc valves 19. An exhalation assembly, as required and fitted to the mask 1 through a surface thereof as is conveniently available, is illustrated in FIG. 3.

Figure 4:
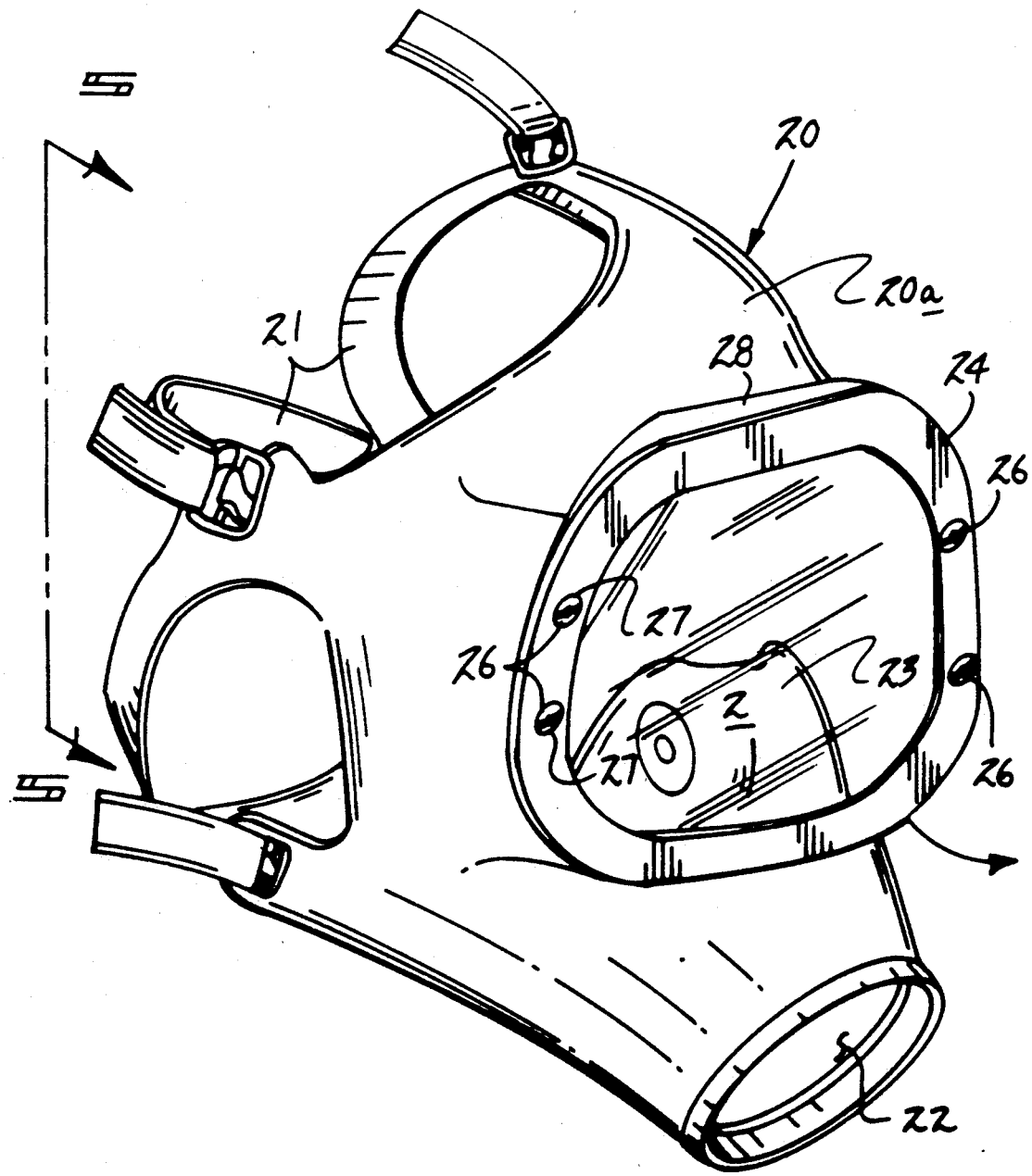
FIG. 4 is an isometric illustration of the modified mask apparatus of the invention.
Figure 5:
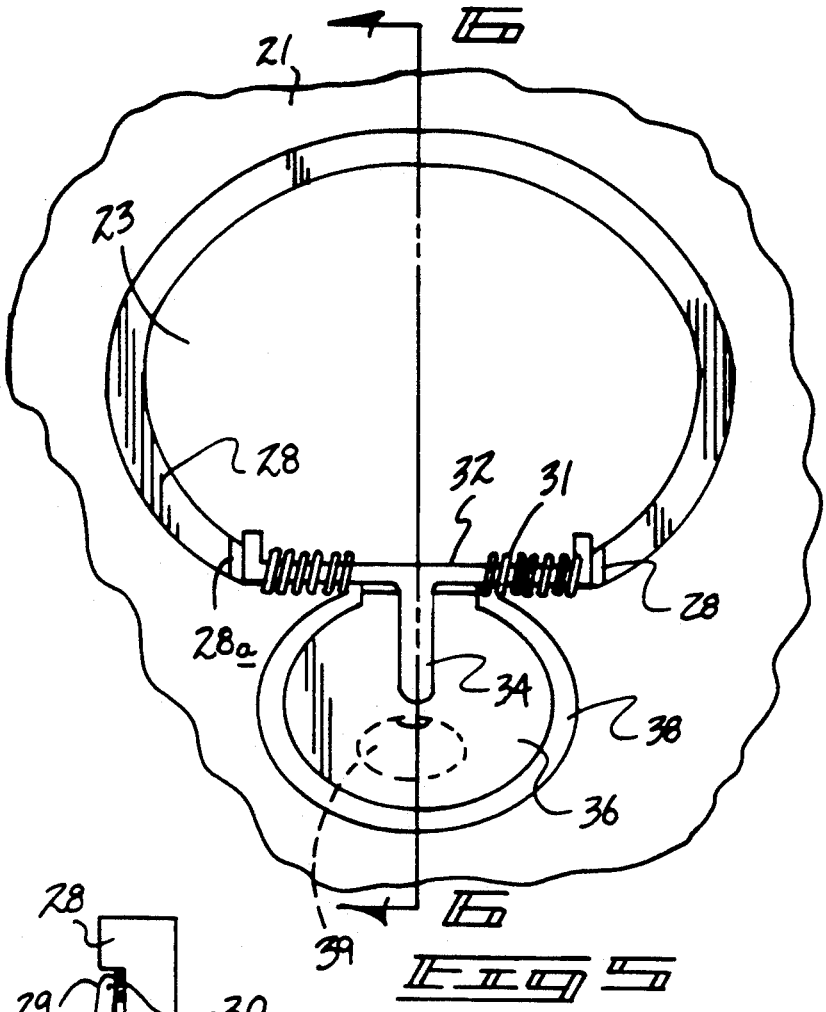
FIG. 5 is an orthographic view, taken along the lines 5—5 of FIG. 4 in the direction indicated by the arrows.
Figure 6:
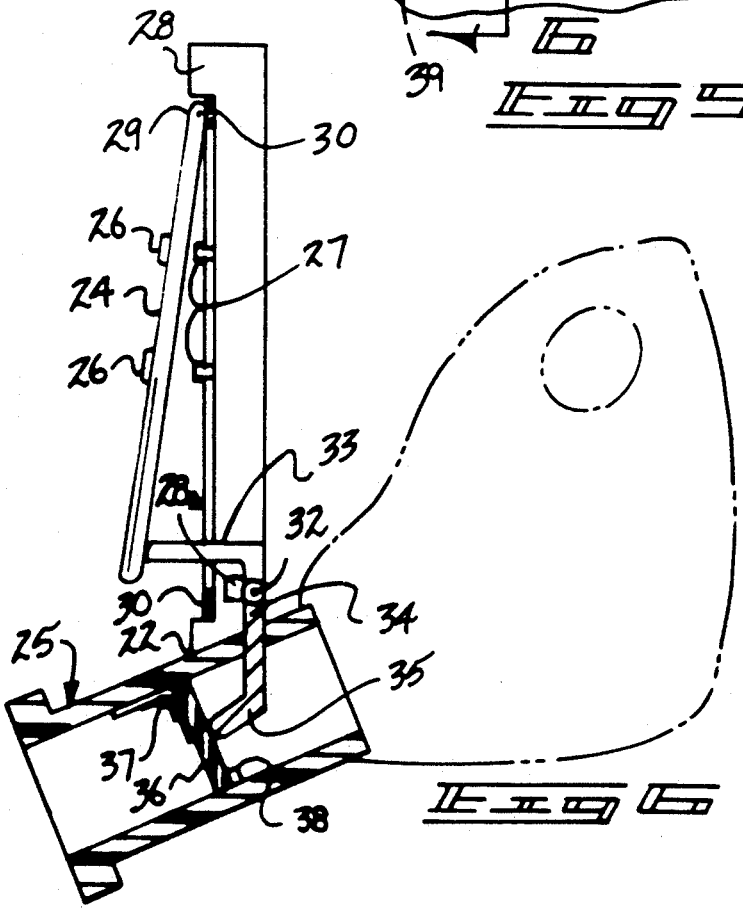
FIG. 6 is an orthographic view, taken along the lines 6—6 of FIG. 4 in the direction indicated by the arrows.

More specifically, the breathing mask apparatus 20 of the instant invention, as illustrated in the FIGS. 4–6, essentially comprises a modified structure to replace the mask assembly 1, as illustrated in FIG. 1 of the prior art incorporated herein by reference and the associated U.S. Pat. Nos. 3,323,135 and 3,348,537 also incorporated herein by reference.

The breathing mask apparatus 20 specifically includes a resilient face cover mask 20*a* and plural pairs of resilient straps 21 to mount the mask about an individual's head portion. An air flow conduit nose 22 is directed through a forward end portion of the cover mask 20*a* for coupling to breathing tube structure 14 of the prior art through an air hose coupling conduit 25 mounted within the air flow conduit nose 22 (see FIG. 6). A viewing face plate 23 is mounted within a face plate frame 24 encircling the face plate 23 that is formed of a transparent material to permit viewing therethrough. The frame 24 further includes plural pairs of latched grommets 26 positioned on opposed sides of the face plate frame 24 cooperative with latch lugs 27 fixedly and orthogonally mounted to a viewing support frame 28 that is fixedly mounted to the cover mask 20*a*. A face plate frame hinge 29 pivotally mounts the face plate frame 24 to the viewing support frame 28, with a support frame seal 30 positioned on the viewing support frame 28 to sealingly engage the face plate frame 24 when the face plate 24 is in contiguous communication with the Viewing support frame 28 and the latch lugs 27 are secured through the latch grommets 26, in a manner as illustrated in FIG. 4.

A spring hinge 31 is mounted to the viewing support frame 28 at a lower portion thereof spaced above and adjacent to the air flow conduit nose 32. The spring hinge 31 includes a spring hinge rod 32. The spring hinge rod 32 mounts a first leg 33 orthogonally and above the spring hinge rod 32, with the first leg 33 including a second leg 34 orthogonally oriented relative to the first leg 33 below the first leg 33 and the rod 32. A third leg 35 positioned at a lower terminal end of the second leg 34 is spaced below the first leg 33 and defines an obtuse included angle between the second leg 34 and the third leg 35. The third leg 35 projects into the air hose coupling conduit 25 in abutment with an air conduit valve plate 36. The air conduit valve plate 36 is mounted within the air hose coupling conduit 25 by a valve plate spring hinge 37 that biases the air conduit valve plate 36 diametrically across the air hose coupling conduit 25 to cease flow therethrough in a first position, as illustrated in FIG. 6, when the face plate frame 24 is in a spaced relationship relative to the viewing support frame 28. An abutment frame 38 mounted rearwardly of and in surrounding relationship relative to the air conduit valve plate 36 within the air hose coupling conduit 25 provides a rear abutment surface for the valve plate 36 in the first position. Upon closure and abutment in a sealing relationship of the face plate frame 24 with the viewing support frame 28, the third leg 35 projects forwardly in pivotment of the rod 32 relative to the viewing support frame 28. The viewing frame 28 conveniently includes mounting lugs 28*a* to pivotally mount the spring hinge rod 32 therebetween. In this manner, cessation of air flow from the mask 14 of FIG. 1 is effected upon the air conduit valve plate 36 oriented in the first position, with the face plate frame 24 in an extended orientation relative to the viewing support frame 28. In this manner, an individual wearing the mask structure 20 may breathe through the support frame 28 and need only utilize an artificial air supply upon closure and effecting a sealing relationship of the face plate frame 24 with the viewing support frame 28.

Finally, illustrated in phantom is a designation for a safety valve plate 39 mounted within the valve plate 36. The safety valve may be formed of conventional spring loaded pressure plate construction positioned and contained within the valve plate 36 whereupon in case of regular to malfunction and the like to avoid air conduit rupturing, the safety valve 39 is calibrated to open to permit directing of air therethrough. This construction is available if required as an additive feature. Further with reference to FIG. 6, the device may be utilized with or without the nose cup assembly per the construction of FIG. 2 in use of the organization, as the valve structure is arranged for mounting within the face mask assembly in operative communication with the associated air conduit structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A breathing mask apparatus, comprising, a resilient face cover mask, the mask including at least one strap pair for securement of the cover mask about an individual and the cover mask including an air flow conduit nose directed through the cover mask, the air flow conduit nose including an air hose coupling conduit, the air hose coupling conduit in pneumatic communication with a breathing tube, and a viewing support frame mounted through the face cover mask above the air flow conduit nose, the viewing support frame including a face plate frame pivotally mounted to the viewing support frame at an upper terminal end of the viewing support frame, and the face plate frame including a transparent viewing face plate contained therewithin, and latch means mounted on the viewing support frame and further latch means mounted on the face plate frame for securement together to effect a sealing relationship between the face plate frame and the viewing support frame, and the latch means includes a plurality of latch lugs mounted to the viewing support frame on opposed sides of he viewing support frame, and the further latch means includes a plurality of latch grommets mounted through the face plate frame, wherein the latch lugs are received through the latch grommets to secure the face plate frame, wherein the latch lugs are received through the latch grommets to secure the face plate frame to the viewing support frame, and the viewing support frame includes a spring hinge mounted to the viewing support frame adjacent the air hose coupling conduit, the spring hinge including a spring hinge rod, and the spring hinge rod including a second leg orthogonally mounted to the spring hinge rod, the second leg including a firs leg orthogonally mounted to the second leg projecting within the viewing support frame, and the second leg including a third leg spaced below the first leg and mounted to a lower terminal end of the second leg defining an obtuse angle between the second leg and the third leg, wherein the third leg projects interiorly of the air hose coupling conduit, and air conduit valve plate hingedly mounted with in the air hose coupling conduit, and the third leg in continuous communication with the air conduit valve plate permitting pivotment of the air conduit valve plate form a first position diametrically aligned within the air house coupling conduit to a second position displaced from the first position, and an air conduit valve plate spring hinge mounted to the air conduit valve plate and the air hose coupling conduit to bias the air conduit valve plate in the first position.

2. An apparatus as set forth in claim 1 wherein the face plate frame is pivotal to a displaced second position in a spaced relationship relative to the viewing support frame form the first position, wherein the face plate frame is in contiguous sealing relationship with the viewing support frame.

3. An apparatus as set forth in claim 2 including an abutment frame mounted with in the air hose coupling conduit rearwardly of the air conduit valve plate to provide an abutment surface for the air conduit valve plate in a first position.

4. An apparatus as set forth in claim 3 wherein the first leg, the second leg, and the third leg define a generally "U" shaped configuration.

* * * * *